US005393197A

United States Patent [19]

Lemont et al.

[11] Patent Number: 5,393,197

[45] Date of Patent: Feb. 28, 1995

[54] PROPULSIVE THRUST RING SYSTEM

[75] Inventors: Harold E. Lemont, Seymour; Andrew I. Lemont, Derby, both of Conn.

[73] Assignee: Lemont Aircraft Corporation, Ansonia, Conn.

[21] Appl. No.: 149,456

[22] Filed: Nov. 9, 1993

[51] Int. Cl.[6] ..... F04D 19/02; F04D 29/54

[52] U.S. Cl. ..... 415/68; 415/211.1; 415/225; 416/247 R

[58] Field of Search ..... 415/68, 119, 186, 187, 415/208.3, 208.5, 209.1, 211.1, 223; 416/247 R

[56] References Cited

U.S. PATENT DOCUMENTS

| | | | |
|---|---|---|---|
| 2,056,547 | 1/1938 | Weber . | |
| 2,123,657 | 7/1938 | Munk . | |
| 2,142,834 | 1/1939 | Bergstrom | 415/211.1 |
| 2,337,954 | 12/1943 | Wolf | 415/209.1 |
| 2,369,279 | 2/1945 | Carnaghan et al. . | |
| 2,439,124 | 4/1948 | Bergstrom | 415/211.1 |
| 2,510,561 | 6/1950 | Laval . | |
| 2,618,435 | 11/1952 | Koch . | |
| 2,625,319 | 1/1953 | Reisch | 415/211.1 |
| 2,628,020 | 2/1953 | Koch | 415/186 |
| 2,876,964 | 3/1959 | Streib . | |
| 2,922,277 | 1/1960 | Bertin . | |
| 2,981,464 | 4/1961 | Omohundro | 415/68 |
| 3,054,578 | 9/1962 | Brocard . | |
| 3,129,905 | 4/1964 | Taylor . | |
| 3,181,811 | 5/1965 | Maksim . | |
| 3,289,922 | 12/1966 | Sawyer . | |
| 3,489,374 | 1/1970 | Morcom . | |
| 3,506,219 | 4/1970 | Mouille et al. . | |
| 3,528,382 | 9/1970 | Clark . | |

(List continued on next page.)

FOREIGN PATENT DOCUMENTS

| | | | |
|---|---|---|---|
| 737957 | 12/1932 | France . | |
| 1444868 | 5/1966 | France . | |
| 458941 | 8/1968 | France . | |
| 2718178 | 11/1978 | Germany . | |
| 2846217 | 5/1979 | Germany . | |
| 1909 | 5/1878 | United Kingdom . | |
| 292493 | 9/1928 | United Kingdom | 415/208.3 |
| 629383 | 9/1949 | United Kingdom | 415/211.1 |

OTHER PUBLICATIONS

H. E. Lemont, Design for Operating Environment Ring-Fin Tail Rotor Program, presented at the American Helicopter Society, Mideast Region, Oct. 22-24, 1980.

H. E. Lemont, Ringfin Augmentation Effects, presented at the 38th Annual Forum of the American Helicopter Society, May, 1982.

*Primary Examiner*—Edward K. Look

*Assistant Examiner*—James A. Larson

*Attorney, Agent, or Firm*—St. Onge Steward Johnston & Reens

[57] ABSTRACT

Improvements to a propulsion thrust apparatus are described wherein a propeller is surrounded by a ring cage structure with which propeller tip vortices are converted to useful mass flow with a plurality of rings whose spacing from each other and the propeller are selected so that in one embodiment at least one ring is placed inside an enclosure and the others are outside. The operation of the propeller then produces an enhanced circulation of the air inside the enclosure without hot spots. In another embodiment, the rings are segmented to provide additional vortices for enhancement of the propeller mass flow. With another embodiment, at last one of the rings are provided with discontinuities on the inside edge to promote the generation of vortices that improve mixing of tip vortices and provide a noise reduction effect. In still another embodiment, the rings are helically shaped and a heater can be incorporated inside the helical ring or the entire ring is made of an appropriately helically shaped heater element. With still another embodiment, a pressure chamber is formed in front of an enclosure or duct or housing and a pair of fans with ring cage structures are placed in tandem partially inside the chamber and partially inside the duct or enclosure to provide an enhanced sealing and increased static pressure handling capability. Other embodiments are described.

27 Claims, 8 Drawing Sheets

U.S. PATENT DOCUMENTS 3,722,454 3/1973 Silvester .
3,738,307 6/1973 Jacobsen et al. .
3,742,895 7/1973 Horiuchi .
3,814,538 6/1974 Sjoqvist .
3,856,238 12/1974 Malvestuto .
4,031,846 6/1977 Tone .
4,152,094 5/1979 Honda et al. ..... 415/208.5
4,196,877 4/1980 Mutrux .
4,506,849 3/1988 Lemont .
4,637,801 1/1987 Schultz .
4,666,411 5/1987 Silvester .
4,689,026 8/1987 Small .
4,694,645 9/1987 Flyborg et al. .
4,815,995 3/1989 Ingvason .
5,292,088 3/1994 Lemont ..... 244/65

SPHERICAL FLOW

CONICAL FLOW

PROPULSIVE THRUST RING SYSTEM

FIELD OF THE INVENTION

This invention generally relates to improved fluid moving and mixing by fans and propellers, as well as propeller and fan-driven vehicles, and particularly, to an improved propulsion system to augment and control thrust for boats and all types of aircraft, fans and other fluid-moving devices.

BACKGROUND OF THE INVENTION

In the copending patent application entitled Propulsive Thrust Ring System filed in the United States Patent and Trademark Office on Jun. 5, 1991 bearing Ser. No. 711,622, now U.S. Pat. No. 5,292,088, a propulsive thrust ring system is described with which vortices from a propeller are converted to useful mass flow. This application and any patent as may issue therefrom is incorporated herein in its entirety by reference thereto.

U.S. Pat. No. 4,506,849 of which I am the inventor is entitled Helicopter Rotor Thrust Ring describe use of a single thrust ring around a tail rotor. Both crossflows from the main rotor and from translational flight are used to enhance thrust from the thrust ring. The area of the single thrust ring required to adopt it for sufficient axial propulsion augmentation would impose too much drag to operate successfully in an axial, high-speed mode.

Townend rings (an early method of streamlining radial aircraft engines) have been used to enclose aircraft propellers to augment thrust. This is an aircraft variant of the shrouds of U.S. Pat. Nos. 3,722,454 and 3,969,944. The same objections which apply to aircraft also apply to water applications. While these Townend ring boost static ground thrust at moderate aircraft translational speeds, drag soon equals the increased thrust effect to reduce the net effectiveness to zero.

Transport aircraft use propulsive fans which are included within a duct/cowling system for noise control. Thrust enhancement by the distribution of negative air pressures on the cowl lip as well as the elimination of the blade tip vortices when the fan blades are located in the duct are claimed. Variations of duct lip pressures with translational and cross flow cause changes in internal duct air velocities, both in direction and magnitude to effect internal fan face velocity distributions. This upsets the match of the required fan blade twist to the duct internal radial air flow distribution and reduces efficiency. To eliminate the tip vortices, the fan blade tips need to be very close to the duct wall (less than 0.5% of the radius) with subsequent clearance problems. The small clearance creates a major disadvantage because of the additional weight required to stiffen the duct structure to prevent contact by the fast-moving blades.

SUMMARY OF THE INVENTION

With a thrust ring augmentation system in accordance with the invention, a substantially improved mass flow is obtained from a propeller and enhanced flow circulation is obtained inside an enclosure. This is achieved by employing a multiple ring cage structure as described in the copending patent application and employing techniques for applying such structure in a unique manner to an enclosure.

One aspect of the invention involves the adaptation of a multiple ring cage structure to an enclosure for electronic equipment such as a computer to cool the internal components with a fan. As described herein for one form of the invention, a motor driven propeller is placed within an opening of the enclosure. A multiple ring cage structure formed of a plurality of rings is then placed to surround the propeller within its axial span. The rings are so sized and so spaced from each other and from the propeller as to enable tip vortices to be converted to useful mass flow. At least one of the rings is placed inside the enclosure while others are mounted outside of it.

With such enclosure mounting, the flow of air into the enclosure is enhanced with improved static pressure. A significant amount of the air flow trying to escape through the opening is redirected by the internally mounted ring back into the enclosure. The internal ring in effect provides, in cooperation with the propeller, a gas seal that reduces escape of air from the enclosure while enhancing internal circulation of air.

A similar sealing effect can be obtained when the propeller operates to exhaust air from the enclosure by placing at least one flow enhancing ring of the multiple ring cage structure both inside and outside of the enclosure. In such case the outside ring in effect provides a seal against the flow of air back into the enclosure by causing a circulation of outside air.

The application of a multiple ring cage structure around a propeller increases the crossectional dimension of the fan, When the enclosure for the fan is of limited height, such as encountered in computers or in the retrofitting of fans with a ring cage structure, differently shaped rings can be used to encircle the propeller with a multiple ring cage structure. The rings can be of various shapes such as oval, angular, for instance six sided or square and can be combined with rings associated with adjacent fans.

The rings can be segmented and arranged in particular patterns such as helical. Increased useful mass flow is obtained by introducing additional tip vortices into educted flow from finite ends of segmented rings. Vortices from these ring tips are used for enhanced mixing. Additional useful vortices are obtained by providing the inside edges of the rings or ring segments with irregularities such as notches, scallops or other deformations. Proper spacing and staggering of the ring segments with respect to a full ring can enhance drawing in of the ring vortices into the wake of the fan. Segmented ring effects can be obtained with a pseudo-segmented ring configuration in which the ring is one piece but its interior edge is provided with large notches almost as deep as the chord dimension of the ring. These notches serve as end edges of segmented rings and promote the generation of desired vortices.

The rings and ring segments can be tilted relative to the central axis so as to lie along a spiral path to produce a spiral educted flow for enhanced mixing. The ring segments can have conical shapes and have other desired torroidal-like surfaces for mass flow enhancement.

It is, therefore an object of the invention to provide improved air circulation through an enclosure with a ring cage structure mounted in accordance with the invention. It is a further object of the invention to provide control over the generation of useful tip vortices from a propeller for enhanced useful air flow or for the reduction of propeller noise or both.

These and other objects and advantages of the invention can be understood from the following detailed description of several embodiments in accordance with the invention as illustrated in the drawings.

DETAILED DESCRIPTION OF DRAWINGS

Figure 1:
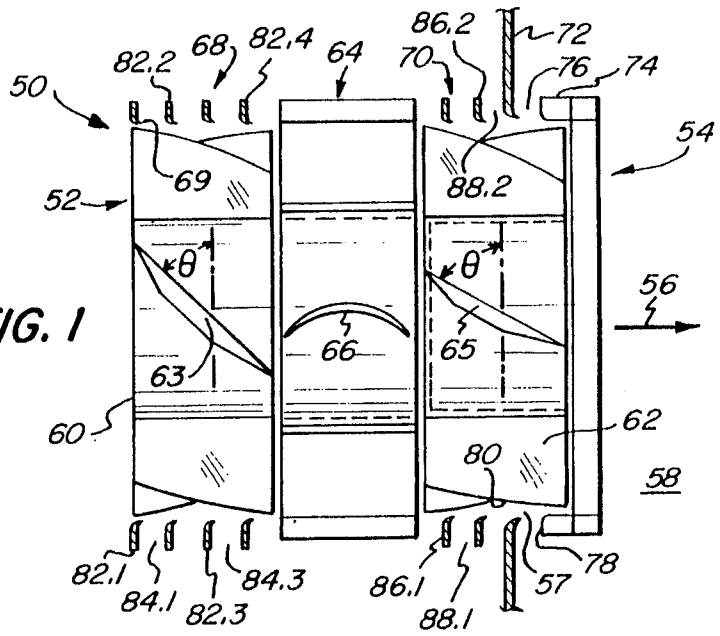
FIG. 1 is a side schematic view in elevation of a multiple fan and ring cage structure in accordance with the invention.
Figure 2:
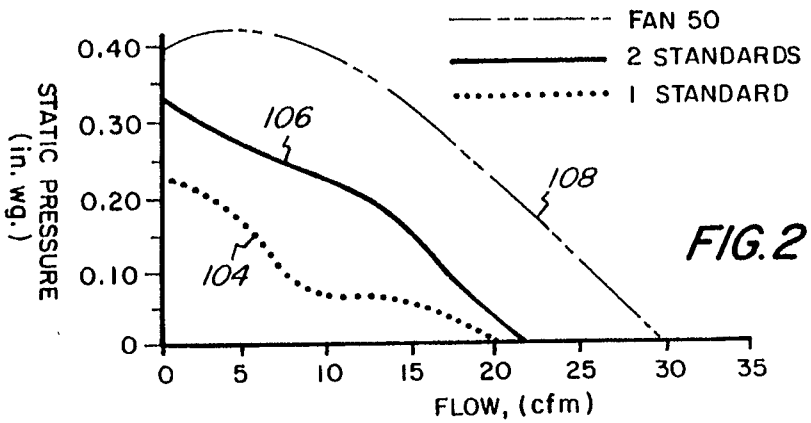
FIG. 2 is a plot of static pressure curves as a function of flow for various fans including the fan shown in FIG. 1.

With reference to FIGS. 1 and 2, a multiple fan structure 50 is shown formed of two independently rotating fans 52, 54, oriented to deliver mass flow in the direction of arrow 56 through an opening 57 into an enclosure 58. Each fan includes a motor-driven propeller 60, 62 whose blades 63, 65 have different pitch angles $\theta$, 45° for propeller 60 and 60° for propeller 62. The propellers 60, 62 operate coaxially and are separated by a flow directing stator 64 with vanes 66 which redirect air flow from propeller 60 with a desired entrance angle into the propeller 62.

Each fan 52, 54 includes a ring cage structure 68, 70 either of the type as generally described in the aforementioned co-pending patent application, now U.S. Pat. No. 5,292,088, or as further described herein.

The propellers 60, 62 may be mounted on a common shaft, not shown, or on individually motor-driven shafts. The entire fan structure 50 is mounted to wall 72 of enclosure 58 with at least one annular ring 74 off ring cage structure 70 at the downstream side being located inside enclosure 58 and spaced inwardly from wall 72 by an annular gap 76.

The upstream edge 78 of ring 74 is located within the axial span of propeller 62 so that the peripheral gap 76 lies within the direct sphere of influence from the tips 80 of the propeller 62. Gap 76 enhance the circulation of air flow within the enclosures 58 while the mass flow and static pressure of fan structure 50 is enhanced by the effect of the ring cage structures 68, 70.

As described in the aforementioned copending patent application, a multiple ring cage structure such as 68 includes a multiple number of rings 82.1–82.4 which are mounted to surround the propeller 60 and are radially spaced from the peripheral sweep line of the propeller blades 63 and located within the axial span of blades 63. One of the rings 82 can serve as a mount for fan 52 to wall 72 of the enclosure using suitable brackets. The rings 82 act as ejectors that convert the normally wasted energy in the blade tip vortices into useful fluid pumping action.

As used herein decimal numbers are intended to identify specific items, while reference to the same number without the decimal refers to the same type of item in a more general manner.

Figure 17:
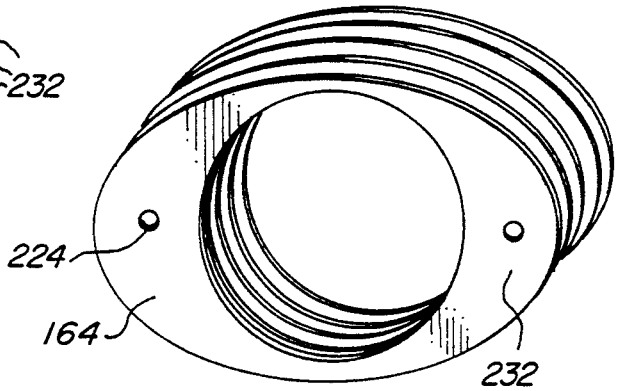
Figure 18:
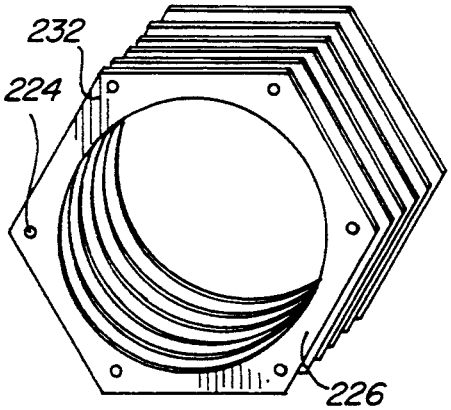

The ring cage structure 68 has three annular ring defined apertures 84.1–84.3 through which air flow mixing with propeller tip shed vortices provides mass flow augmentation for the fan 52. The rings can be of diverse shapes and be segmented as described herein. In the fan 52 rings are of an oval construction as shown in FIG. 17. The rings are typically relatively thin structures whose radial width (outer radius less inner radius) or chord, c, and axial spacing, w, are selected to enhance flow augmentation by the ring structure 68. If the ring chord, c, is made too large, the augmentation effect tends to diminish and drag, in vehicular application, may become too large. If the ring chord is too small, the augmentation effect also tends to diminish. The size for the ring chord, c, can be expressed as a function of the fan radius R and preferably should be in the range from about 0.15 R to about 0.60 R. Particularly effective flow augmentation was found at a ring chord dimension of about 0.25 R.

Ring thickness t also affects performance with augmentation being reduced when a ring is too thick or too thin. Generally, a ring's thickness is expressed as a function of the chord size c. The ring thickness t preferably is in the range from about 0.1 c to about 0.4 c with augmentation flow generally declining as the ring thickness approaches 0.35 c. Ring maximum thickness generally was found to yield maximum static flow augmentation from about 0.15 c to about 0.2 c. In one multiple ring structure using four rings with a two-bladed propeller in an eight inch diameter fan, an optimum value for the ring thickness t was 0.2 c. Improved mass flow can be obtained even with a ring thickness smaller than 0.1 c.

The axial spacings W between rings, i.e. the axial widths, w, of annular ring defined apertures should be sufficient for air flow from vortices to augment the mass flow. If the apertures are widened, flow augmentation gradually reduces. When the aperture width w becomes zero, performance approaches the augmentation obtained with a single ring. Preferably, the widths, w, of the ring flow apertures are generally selected to between about half to about four ring chord lengths c, though variations from this range may be encountered with different media such as air and water.

Generally, the forward ring 82.1 should not be forward of the tip vortex and in the embodiment herein is located within the axial span of the propeller blades 63. Generally, flow augmentation reduces more rapidly as the position of forward edge of ring 82.1 is moved more forwardly than rearwardly. Augmentation of the flow was obtained for one fan, using a pair of blades as long as the trailing edge, such as 69, of the forward ring was no further forward from the plane of rotation than about 0.06 of the radius R of the propeller and no further downstream than about 0.2 R. Variations from these locations can be made depending on various propeller factors, such as the strength of the vortices produced by the blades.

A particular advantage of a ring cage structure such as 68 is that its inner diameter does not have to be closely spaced to the peripheral sweep line of the propeller blades 63. When the clearance, s, is too small, tolerances required of the fan and mounting structures become tight to avoid inadvertent contact with the ring structure 68. If the clearance, s, is too large, then the beneficial effects from the ring cage structure 68 reduces and a reverse air flow becomes possible. Generally, a tip gap, s, that is of the order of no more than about 10% of the radius R of the propeller blade is acceptable with about 5% of R being normally used.

Figure 2A:
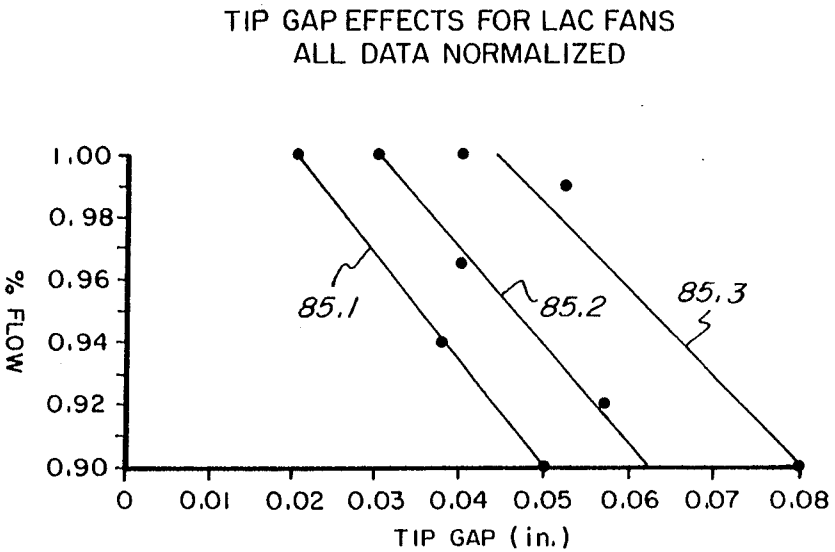
FIG. 2A is a plot of the effects on the flow of a fan when the tip gap between a propeller blade and the surrounding ring changes.

The tip gap s may vary in actual dimension for any one size fan. FIG. 2A illustrates straight line plots of the effect of changes in the tip gap s on the flow of a fan with a ring cage structure. The plots 85.1, 85.2, and 85.3 are respectively for a 60 mm, 80 mm, and 120 mm fan and demonstrate that the flow diminishes as the tip gap s increases.

Since both ring/blade gap and ring chord are interdependent, their effects can be handled in the following manner. When one of these parameters is operating "off peak" the maximum effect of the other is also reduced. As a general design criteria, therefore, for every 1% off peak for the ring blade gap, the ring chord operates below its maximum by about 3%.

The multiple ring cage structure 68 works particularly well with propeller blades 63 having a relatively low aspect ratio. Aspect ratio (AR) for a propeller blade is defined by the relationship $AR=b^2/A$ where b is the exposed length of the blade outside of the hub and A is the blade area outside of the hub. When the aspect ratio for blades 63 is too high, the strength of the tip vortices is lowered and thus the benefit of the ring cage structure 68 is diminished. With lower aspect ratios for the propeller blades, a stronger tip vortex is generated which can then be converted to useful mass flow and provide better overall efficiency.

Low-aspect ratios found suitable typically are in the range from about 0.10 to about 3.0, though the invention can work to some extent with propeller aspect ratios that are outside this range. AR ratios in the range from about 0.4 to about 1.0 can give two to three times the flow of a normal fan.

The solidity ratio for the propeller affects the performance of a fan with a ring cage structure. Solidity ratio is defined as the total projected area normal to the chord plane of the blades divided by the blade swept area. Values of solidity ratios in the range from about 0.80 to about 1.2 tend to be preferred, though variations from this range may be useful, particularly when the partial back pressure is about 0.10 inches. Flow improvements have also been measured for solidity ratios in the range of 1.6.

The size of the hub of the fan tends to influence performance of the fan. Generally, the hub to tip ratio, i.e. the ratio between their diameters, should be less than about 0.5.

Special feature may be adopted to increase fan flow or to reduce noise. For example, the use of an even number of blades with different pitch angles, such as 40 degrees and three alternate blades with pitch angles of 45 degrees enables the tip vortices to be so relocated that they tend to intermingle with each other and thus increase the pumping action from the adjacent ring injectors. Propeller blade beveling also effectively enhances the effect of the ring cage structure.

The downstream fan 54 has a ring cage structure 70 wherein the downstream ring 74 is located within the enclosure and the upstream rings 86.1 and 86.2 are outside the enclosure 58. The apertures such as 88 and gap 76 between the rings 86 and between the rings 86.2 and 74 and the wall 72 enable tip vortices to be converted to useful mass flow and thus provide flow enhancement and expansion of the downstream wake of the fan 50 inside the enclosure 58.

Figure 6:
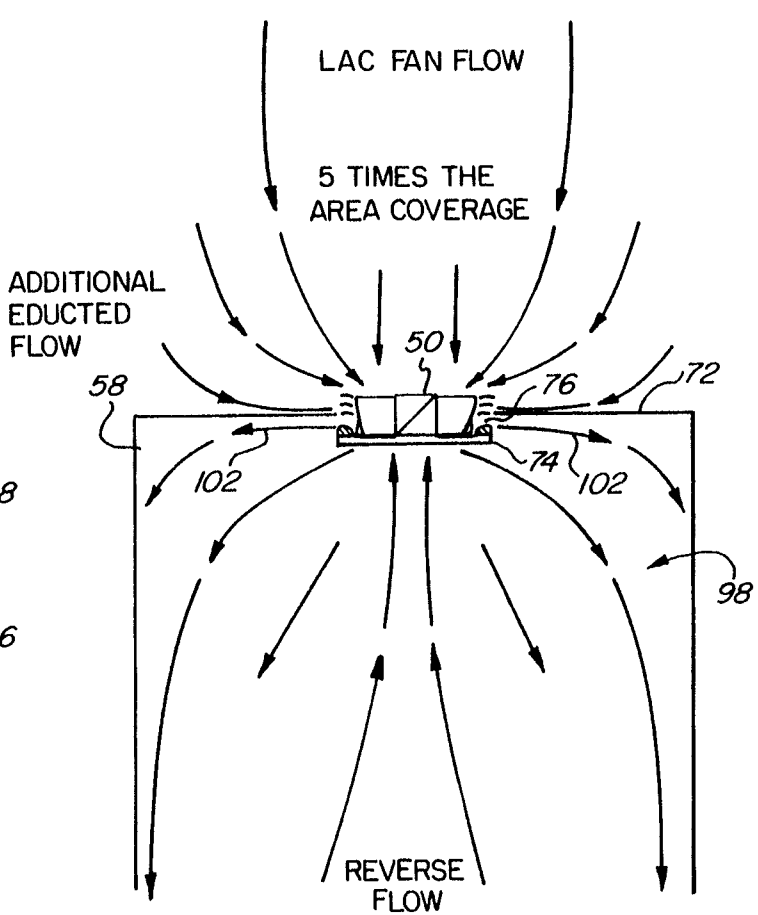
FIG. 6 is a diagrammatic view of the air flow for a fan with a ring cage structure mounted on an enclosure in accordance with the invention.
Figure 5:
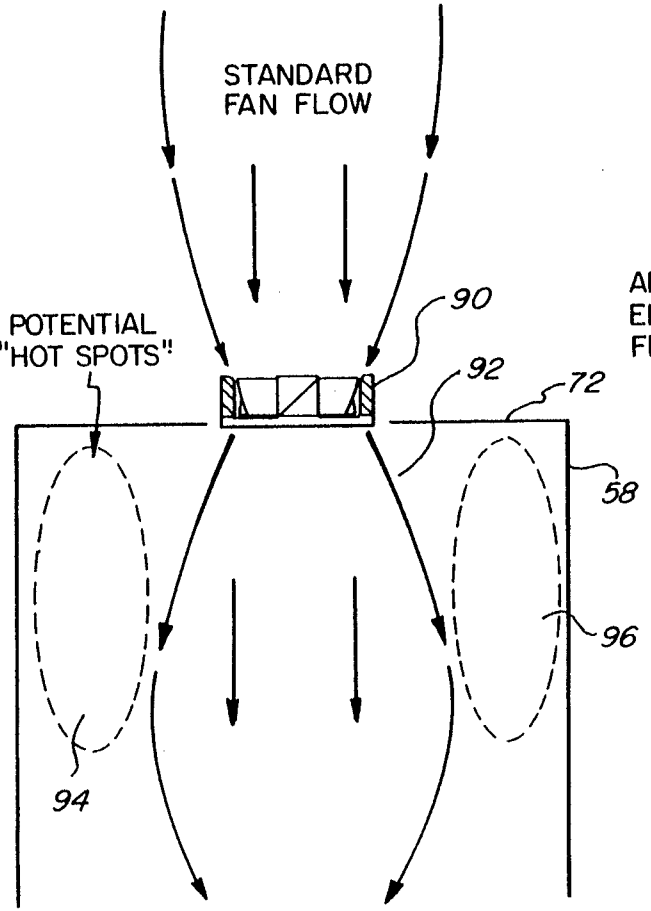
FIG. 5 (PRIOR ART)
FIG. 5 is a diagrammatic view of the air flow from a standard fan mounted on an enclosure.

With reference to FIGS. 5 and 6 a visualization of the flow of fan 50 and standard tube fan 90 within an enclosure 58 are illustrated. The flow patterns are not intended to be an exact representation, but indicate a significant difference between the flows produced inside an enclosure by a fan in accordance with the invention and that of a comparable standard tube fan. In FIG. 5 a standard tube fan 90 produces an internal flow pattern 92 that can be generally characterized as conical, i.e. a fairly narrow pattern which tends to leave side located regions such as 94 and 96 relatively undisturbed and thus permit these to become so called "hot spots".

In FIG. 6 a flow pattern 98 inside an enclosure 58 is shown for a fan mounted in an inside-outside manner as shown for the fan 50 in FIG. 1. The flow pattern 98 is characterized by a much broader pattern that approaches a spherical shape, subject to the various components that may be inside the enclosure 58 and constraints imposed by its size.

The broader pattern 98 tends to produce a central reverse flow 100, which when it returns to the fan 50 tends to be redirected out in a centrifugal path 102 through the gap 76 between the downstream ring 74 and the wall 72. As a result the fan 50 introduces a recirculation pattern that tends to reach all regions inside the enclosure 58 with few "hot spots" and a substantially improved cooling capability. The fan 50 may in such case be operated at a lower speed and operate much quieter than the standard tube fan 90 of FIG. 5.

Performance characteristics of the fan and its mounting on the enclosure can be appreciated from the measured static pressure curves 104, 106, and 108 shown in the plot of FIG. 2. Curve 104 is for a standard tube fan, such as 90 in FIG. 5, curve 106 is for a tandem arrangement for a pair of such standard fans when mounted in a conventional manner on an enclosure and curve 108 is for fan 50 as mounted in the manner shown in FIG. 1. A substantial greater amount of mass flow is obtainable with a fan 50 at the typical static pressure ranges, 0.05 to 0.15, applicable to electronic equipment enclosures.

Figure 3:
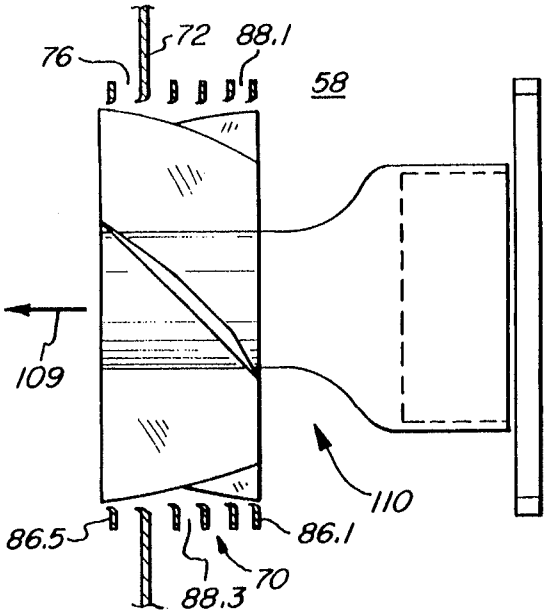
FIG. 3 is a side schematic view in elevation of a fan and enclosure mounting in accordance with the invention.
Figure 4:
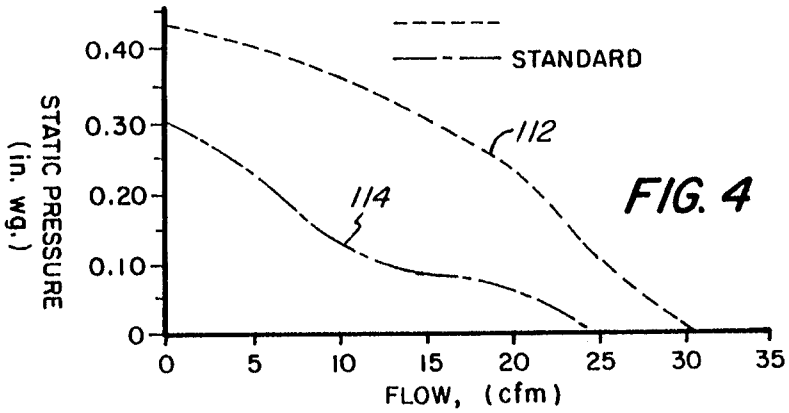
FIG. 4 is a plot of static pressure curves as a function of flow for various fans including the fan shown in FIG. 3.

FIG. 3 illustrates a single fan 110 with a ring cage structure 70 that is similar to and mounted in a similar manner to an enclosure 58 as fan 54 in FIG. 1, except that the fan in FIG. 3 is primarily mounted inside the housing 58 and the fan is operated in an exhaust mode as illustrated by the direction of flow indicating arrow 109. The static pressure curves 112 and 114 shown in FIG. 4 are respectively for fan 110 and a standard tube fan of comparable size operating at a fan speed of 5600 rpm and using oval rings.

The ability of fans such as 50 and 110 to produce significantly greater flow than conventional tube fans and deliver a better recirculation pattern inside an enclosure, enables one to design the properly sized fan for a particular enclosure while operating the fan at a speed that makes it unusually quiet. Fan noise, traditionally can be reduced with DC powered fans by reducing their operating speed. However, even with a speed reduction for a standard tube fan its noise is substantially louder than the low noise level that can be achieved with fans and fan mountings as shown herein.

Figure 7:
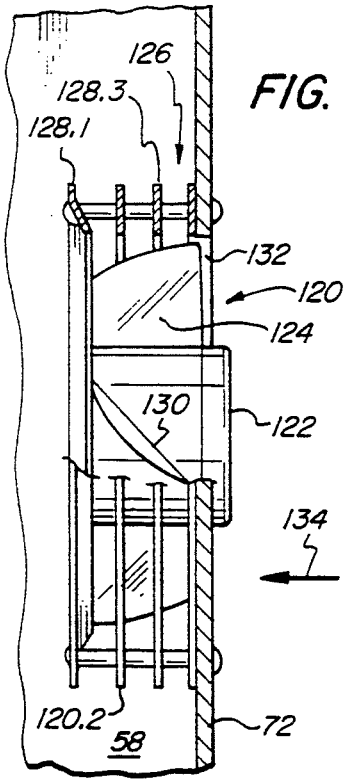
FIG. 7 is a partially broken away side and section view of a fan and with a ring cage structure mounted in accordance with the invention.

With reference to FIGS. 7–10 various fans and fan mountings are shown. In FIG. 7 a fan 120 is shown with a motor 122, a propeller 124 and a ring cage structure 126 whose flow enhancing rings 128 are except for the upstream leading ring 128.1 all located within the axial span of the propeller 124. The propeller 124 is of the low aspect ratio type preferably with blades 130 that have a generally rectangular planform shape. Fan 120 is mounted entirely within the enclosure 58 in front of its circular opening 132 in wall 72. Air flow is in the direction of arrow 134 into enclosure 58.

Figure 8:
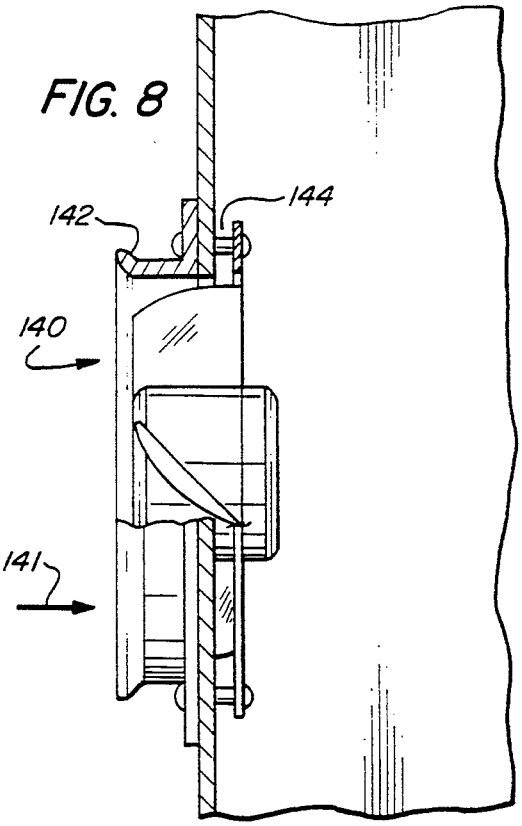
FIG. 8 is a partial broken away side and section view of a tube fan with a pseudo-ring cage structure and enclosure mounting in accordance with the invention.

FIG. 8 illustrates mounting of a standard tubular fan 140 onto wall 72 of enclosure 58 for moving air into it as shown by arrow 141. The tubular housing 142 for fan 140 is provided with peripheral gaps 144 inside the enclosure 58. The gaps 144 can be made with a flow augmenting ring such as 128 in FIG. 7 or by cutting slots in the housing 142 to simulate the effect of a ring 128. The performance of a fan 140 does not approach that of fan 120, but some improvement in flow pattern is achieved over a standard fan.

Figure 9:
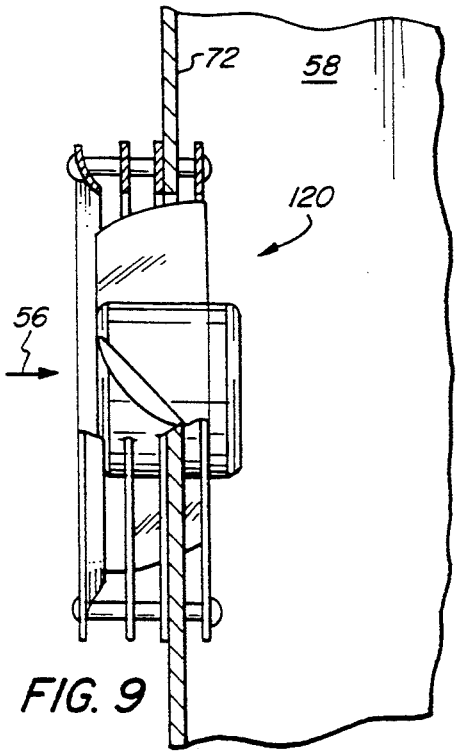
FIG. 9 is a partial broken away side and section view of a fan with another ring cage structure and enclosure mounting in accordance with the invention.
Figure 10:
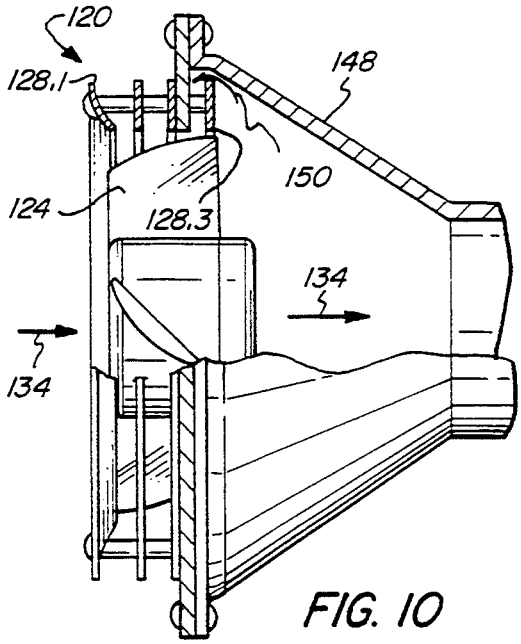
FIG. 10 is a partial broken away side and section view of a fan and a ring cage structure mounted to an conical enclosure in accordance with the invention.

With reference to FIGS. 9 and 10 a fan such as 120 is mounted in an inside-outside manner on an enclosure 58 in FIG. 9 and on a conical housing 148 in FIG. 10. The fan housing 148 is particularly effective in providing a gas seal because reverse flows of air as represented by arrow 150 tend to be redirected through annular gap 152 into useful mass flow going downstream of propeller 124.

Figure 11:
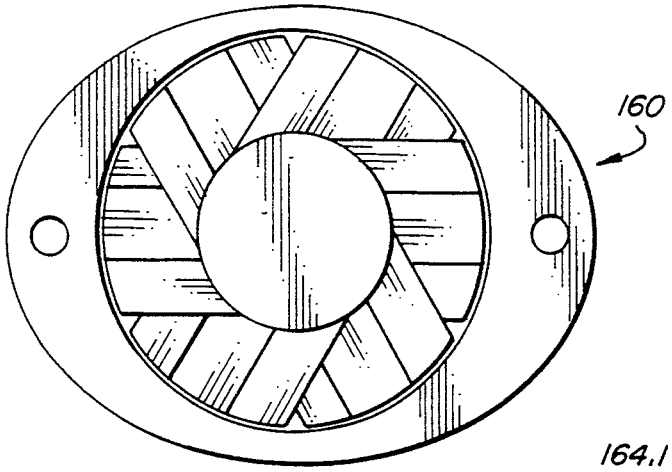
FIG. 11 is a front view in elevation of a fan with a ring cage structure using oval rings and a mounting, in accordance with the invention.
Figure 12:
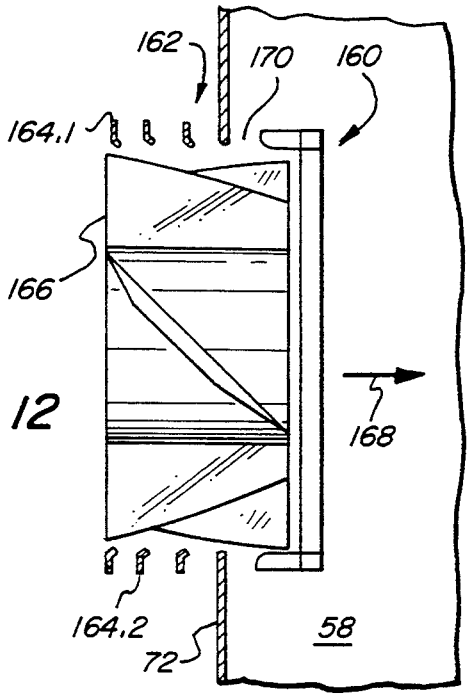
FIG. 12 is a side schematic and section view of the fan of FIG. 1 mounted to an enclosure in accordance with the invention.
Figure 13:
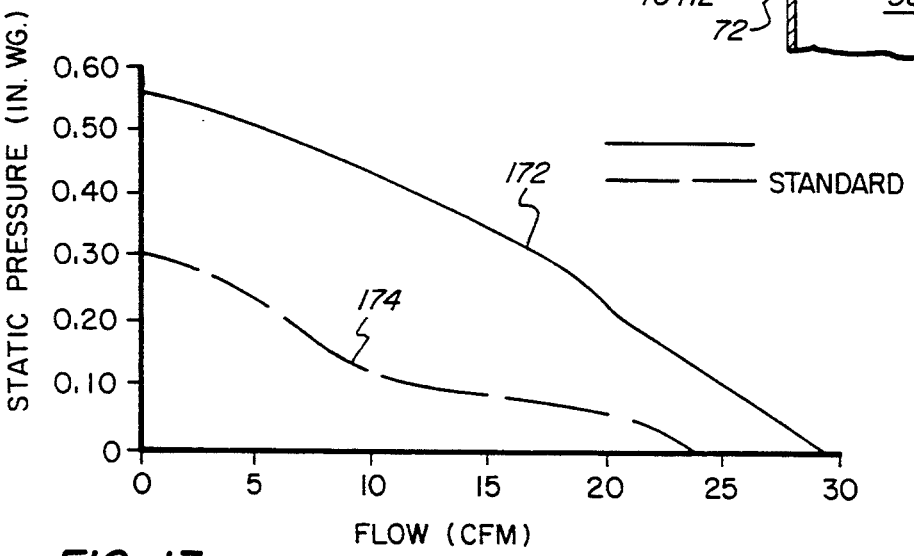
FIG. 13 is a plot of static pressure curves as a function of flow for various fans including the fan shown in FIGS. 11 and 12.

With reference to FIGS. 11–13 a fan 160 is shown mounted to an enclosure 58 like fan 54 in FIG. 1. Fan 160 has a ring cage structure 162 formed with rings 164 mounted around a propeller 166. The propeller is of the planform, beveled type as shown and described in the aforementioned copending patent application. The rings 164 are oval shape. The propeller 166 has a sufficient number of blades 168 (namely 6) so as to present a solidity ratio that approaches unity. The fan is operated to drive air into the enclosure 58 as shown by the flow direction arrow 168. A recirculation of air inside the enclosure through the inner annular gap 170 provides enhanced sealing and thus yields a higher static pressure as illustrated in FIG. 13 with the static pressure curve 172 in comparison with the performance represented by the static pressure curve 174 for a standard comparably sized tube fan.

Figure 14:
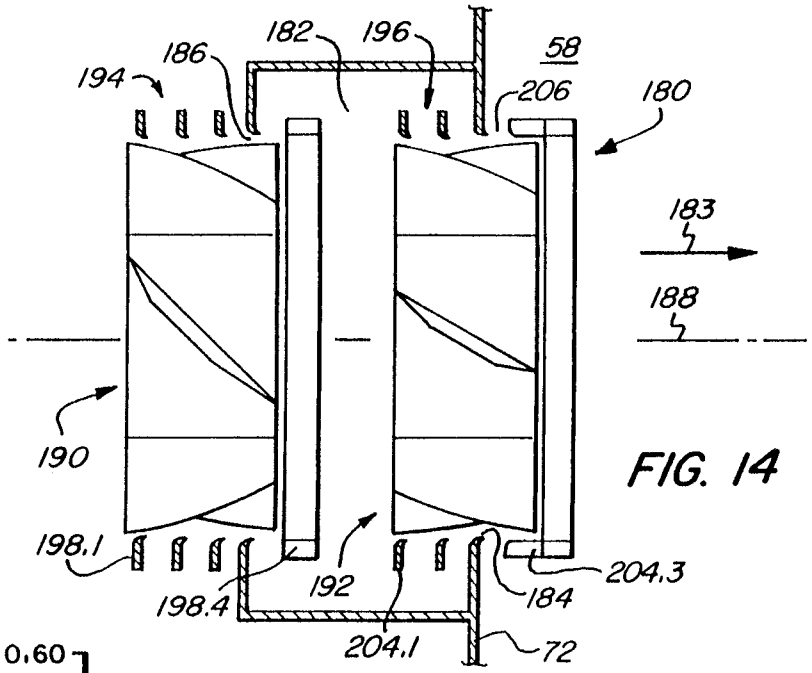
FIG. 14 is a side schematic and section view of multiple fans with ring cage structures and mounted with a pressure chamber to an enclosure in accordance with the invention.

In FIG. 14 a fan structure 180 is shown mounted to an enclosure 58 using a pressure chamber 182 to deliver a flow of air in the direction indicated by arrow 183 into enclosure 58. Chamber 182 is formed in front of a fan opening 184 and has a second opening 186 that is aligned along the rotational axis 188 for the fan structure 180. A pair of fans 190 and 192 with ring cage structures 194, 196 are mounted in the openings 184, 186. Ring cage structure 194 has one downstream located ring 198.4 inside pressure chamber 182 spaced from wall 200 by an annular gap 202. Similarly, ring cage structure 196 has a downstream located ring 204.3 located inside enclosure 58 and spaced from wall 72 by an annular gap 206.

Figure 15:
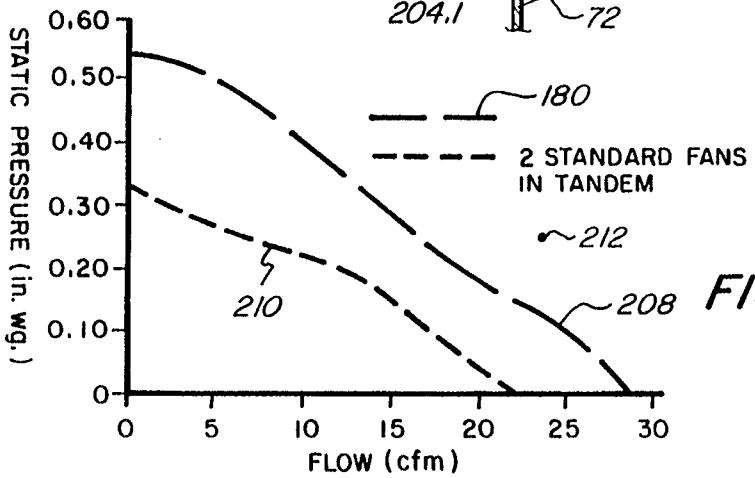
FIG. 15 is a plot of static pressure curves as a function of flow for several fans including the fan of FIG. 14.

With the fan structure 180 a double air seal against reverse air flow is obtained so that a significantly improved static pressure curve is achieved. This is illustrated at 208 in FIG. 15 in comparison with a static pressure curve 210 for a pair similarly sized standard tube fans operated in tandem.

Curve 208 was obtained by operating the fan structure at a rotational speed of 4800 rpm, while the curve 210 was obtained with a speed of 5600 rpm. When the fan structure 180 is operated at 5600 rpm the static pressure curve shifts away from curve 210. In such case the flow at a static pressure of 0.27 inches would be about 23 cfm as shown with the data point at 212.

With a fan 180 a relatively high system air resistance within the enclosure 58 can be tolerated because of the fan's high static pressure generating ability. Fan 180 may also be used inside a jet engine to enhance the flow and compression of air therein.

Figure 16:
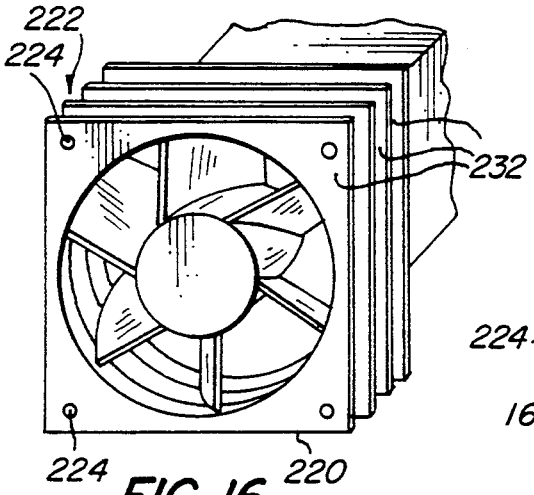
FIGS. 16–20 are generally frontal perspective views of ring cage structures employing differently shaped rings in accordance with the invention.
Figure 19:
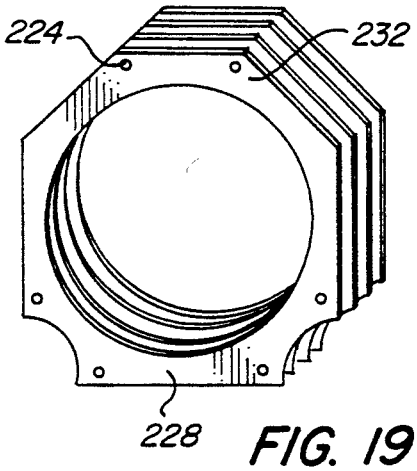
Figure 20:
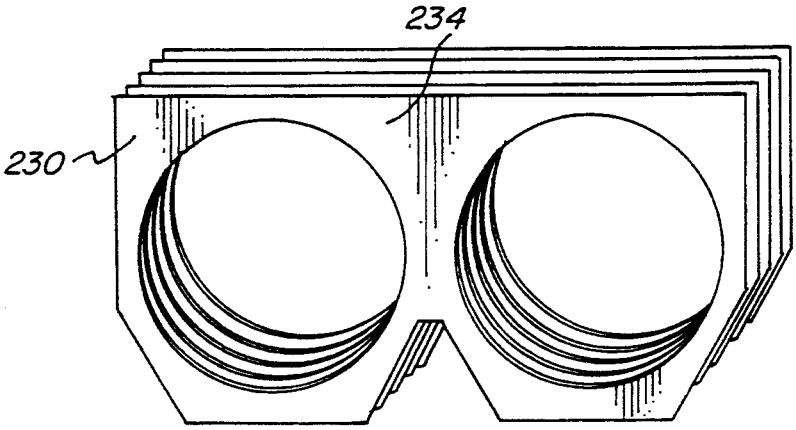

With reference to FIGS. 16–20 various other plan shapes for the rings in a ring cage structure of the invention are shown. In FIG. 16 square shaped rings 220 are used with a propeller of the low aspect ratio type. Square shaped rings are particularly useful in box fans such as are commonly found in household fans. The stack 222 of rings 220 are held together with suitable screws and stand-off elements, not shown, extending through corner located holes 224. In FIG. 17 oval shaped rings 164 are shown and in FIG. 18 the rings 226 are hexagonal with suitable mounting holes 224. In FIG. 19 the rings 228 are multifaceted to accommodate a desired fan form factor. In FIG. 20 rings 230 are sized to accommodate a pair of side by side fans.

With these various plan shapes for the rings, variations from the performance of circular rings can be expected and do occur. These changes arise from the variations of portions of the rings from optimum such as at corners 232, and at 234 between the fan openings 236. Nonetheless these rings still provide significant flow enhancement by their substantial ability to convert propeller tip vortices into useful mass flow. For example, if in a 60 mm diameter fan the use of round rings produces about 32.5 cfm in free flow, the use of oval rings resulted in a loss of flow of about 7% and the use of square rings resulted in a free flow of about 27 cfm or about 22% less than for round rings.

The term ring as used in this application, therefore, is not limited to circular shapes, but can include such other shapes as described and shown herein as well as such other shapes as may appear desirable for a ring cage structure within which the rings provide flow enhancement as described herein and the copending patent application.

Figure 21:
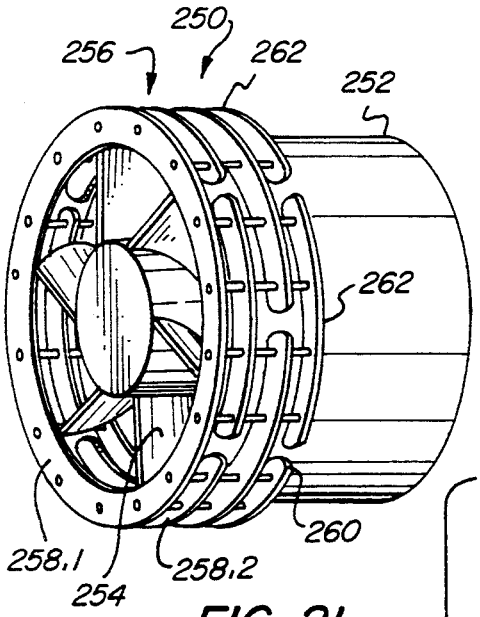
FIG. 21 is a perspective view of a fan with a ring cage structure using segmented rings in accordance with the invention.

With reference to FIGS. 21–32 rings are shown which can be segmented and provided with particular crossections and protuberances to promote their effectiveness. In FIG. 21 a fan 250 is shown with a motor 252, a propeller 254, and a ring cage structure 256 wherein some of the rings 258.2, 258.3 and 258.4 are segmented. Segmentation has been found to yield additional vortices from circumferentially ends 260 of segments 262. These end vortices arise from an inter-relationship with vortices from the propeller tips. These additional segment end generated vortices enhance the mixing and flow enhancement of the fan 250.

Figure 22:
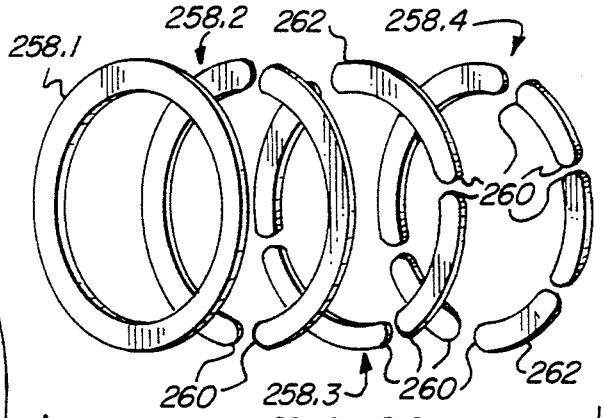
FIG. 22 is an exploded perspective view of rings employed in the ring cage structure shown in FIG. 21.

The number of segments into which a ring 258 may be divided can vary. Preferably the upstream leading or front ring 258.1 is not segmented and subsequent rings divided into segments whose number increase with increased distance from the upstream end of the fan primarily so as to circumferentially stagger the segment ends along the fan axis. For example as shown in the view of FIG. 22 ring 258.2 is split into two parts, ring 258.3 into four parts and the trailing ring 258.4 formed of six segments 262. As a result the segment ends 260 are staggered for better mixing while the expanding flow from the fan can be further enhanced from the increase in the number of circumferential segment ends 260 in the downstream direction.

Staggering, although it is not always needed, can also be achieved without increasing the number of segments for different rings 258 by angularly shifting the location of the segments 262 in the downstream direction. The angular spacing or distance between ring segments can be varied depending on the desired performance.

Figure 27:
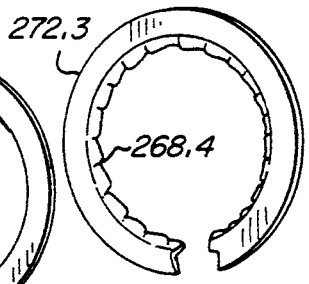
Figure 28:
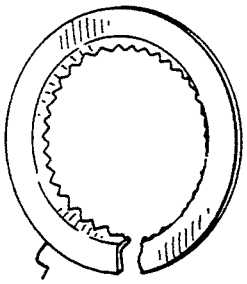
Figure 29:
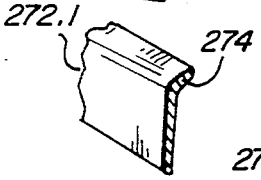
FIGS. 29–32 are enlarged partial broken away perspective sectional views respectively of the rings shown in FIGS. 25–28.

The segmentation of a ring 258 can also be done in a pseudo-segmented ring wherein a solid ring, such as 258.1 is deeply notched at regular angular intervals. The notches in such case may be as shown in FIG. 27 but their radial size extended almost through the chord width of the ring.

Figure 23:
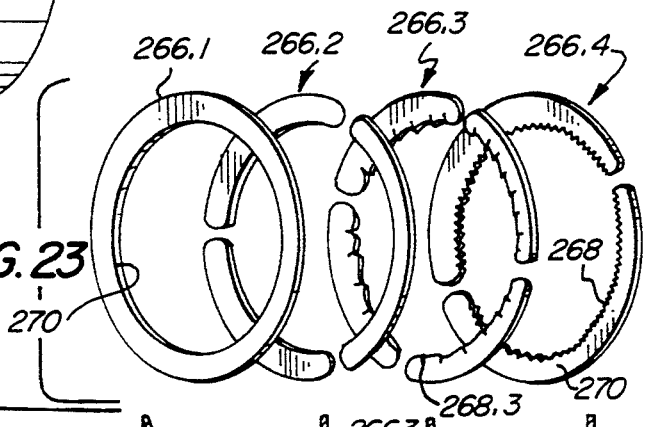
FIG. 23 is a perspective exploded view of rings of different crossectional shapes with deformations intended to generate vortices for enhanced mixing in a ring cage structure.
Figure 24:
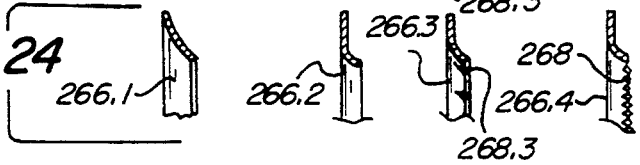
FIG. 24 is a perspective exploded partial and section view of portions of rings shown in FIG. 23.
Figure 25:
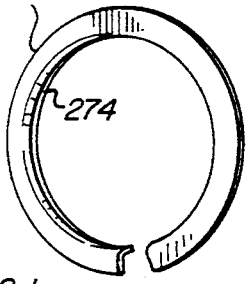
FIGS. 25–28 are partially broken away perspective views of various rings for use in a ring cage structure in accordance with the invention.
Figure 26:
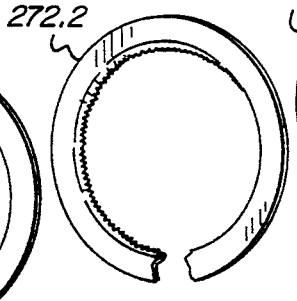

Another enhancement of the ring cage structure of this invention involves the crossectional shaping of rings as shown in FIGS. 23–32. In FIGS. 23 and 24 rings 266 are shown wherein some of the downstream located rings 266.3 and 266.4 are provided with irregularities or discontinuities 268 on their radially inner edges 270. These irregularities provide an effective technique to control and reduce noise from the operation of the fan.

Figure 30:
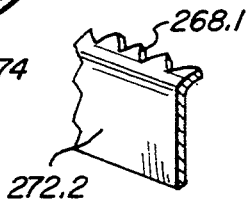
Figure 31:
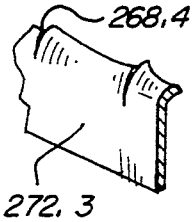
Figure 32:
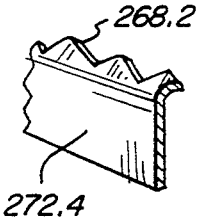

In addition the rings 266 are shaped to generally lie along curved conical surfaces as shown in the crossectional views of FIG. 24. The shapes of the rings 272 in FIGS. 29–32 can be generally planar with inner edges 270 provided with downstream oriented lips 274. These lips can then be provided with irregularities 268 as shown in FIGS. 30, 31.

The irregularities 268 can be in the form of regularly shaped teeth 268.1 or scallops 268.2 or notches 268.3 or raised bumps 268.4 or such other deformations at the inner edges 270 as will enhance the tip vortex conversion to useful mass flow in the downstream direction.

Figure 33:
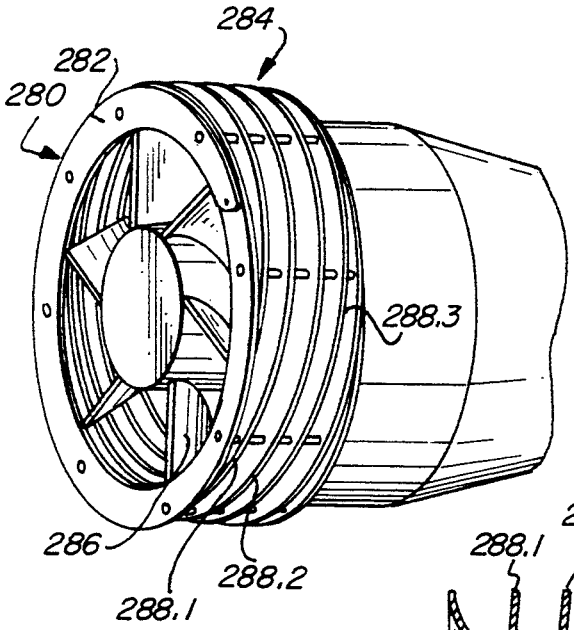
FIG. 33 is a perspective view of a fan and ring cage structure using a helical ring configuration in accordance with the invention.
Figure 34:
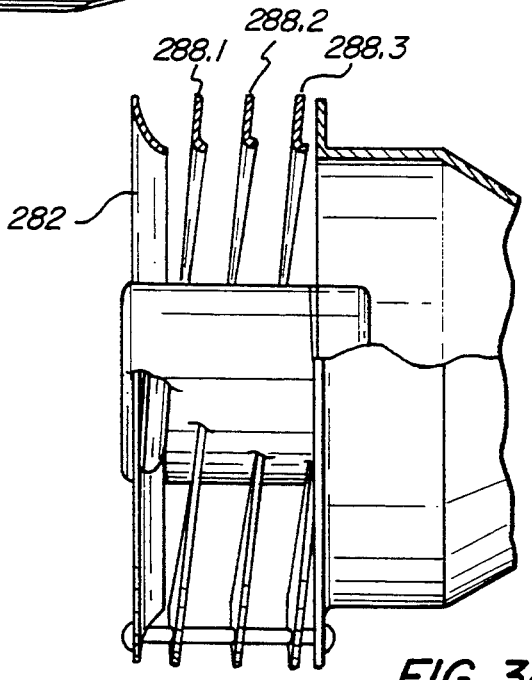
FIG. 34 is a broken away side and sectional view in elevation of the fan shown in FIG. 33.
Figure 35:
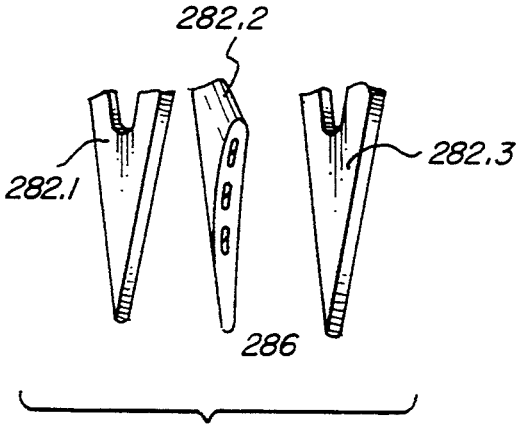
FIG. 35 is a section view of the helical ring employed in the fan of FIGS. 33 and 34.

In FIGS. 33–35 a ring cage structure 280 and rings 282,284 are shown that are particularly useful when a continuous element such as a heater element 287 is incorporated within the ring cage structure such as may be used for a hair drier. In the embodiment of FIGS. 33, 34 the ring 284 is inclined relative to the rotational axis and is shaped to form a continuous helical element that is mounted in a continuous helical path around the propeller 286. The rings 282 and the ring portions such as 288.1, 288.2, and 288.3 of continuous ring 284 are sized, spaced and located to provide the flow enhancement as heretofore described. An alternate arrangement for a heater involves employing a flattened heater element which is shaped into the form of the continuous helical ring 284. In such case an appropriate peripheral protective frame, not shown, may be needed around the heating helical element 284.

Having thus described several embodiments in accordance with the invention its advantages can be appreciated. The invention has been described in connection with improvements achievable with air flow producing devices. However, it should be understood that the invention can be employed with liquids and the term fan as used herein should include propellers and ring cage structures used to drive liquids such as water for boats, pumps and the like. Variations can be made to the embodiments without departing from the scope and spirit of the invention as set forth in the following claims.

What is claimed is:

1. An apparatus for moving fluid through an opening in an enclosure, wherein the enclosure has a wall to which the apparatus is mounted, comprising:

a motor;

a propeller mounted in the opening and being coupled to the motor for rotation thereby about an axis to move fluid downstream through the opening in the wall;

a multiple ring cage structure formed of a plurality of rings and placed to surround the propeller within its axial span, said rings being so sized and so spaced from each other and from the propeller as to enable fluid tip vortices from the propeller to be converted to useful fluid flow;

selected rings being mounted to one side of the wall with at least one of said rings being mounted on the other opposite side of the wall around the opening, said one ring being so spaced from the wall so as to redirect upstream directed fluid flow attributable to a back pressure on the other side of the wall, into useful fluid flow, whereby a fluid seal effect is obtained between the propeller and the wall to reduce seepage of downstream fluid flow back through the opening.

2. The apparatus in accordance with claim 1 wherein said propeller has a relatively low aspect ratio.

3. The apparatus in accordance with claim 2 wherein selected rings are formed of separate segments spaced from the propeller, said segments having circumferential ends for producing vortices which enhance the conversion of propeller tip vortices to useful fluid flow.

4. The apparatus in accordance with claim 3 wherein said segments are arranged around the propeller along a spiral path.

5. The apparatus in accordance with claim 1 wherein said rings have an external rectangular shape.

6. The apparatus in accordance with claim 5 wherein the rings have an external square shape.

7. The apparatus in accordance with claim 1 wherein the rings have an external oval shape.

8. An apparatus for moving fluid through an opening in an enclosure bounded by a wall to which the apparatus is mounted, comprising:

a motor;

a propeller mounted in the opening with the wall being within the. axial span of the propeller, the propeller being coupled to the motor for rotation thereby about an axis to move fluid downstream through the opening;

a propulsion ring being so mounted with respect to the wall so that the ring and the wall surround the propeller within Its axial span, said ring being so sized and so spaced from the wall and from the propeller as to form a flow augmentation aperture therewith with which an upstream fluid flow is converted by the propeller to useful fluid flow;

whereby a fluid seal effect is obtained between the propeller and the wall for a reduction of seepage of the upstream fluid flow through the opening.

9. The apparatus as claimed in claim 8 wherein a plurality of said rings is placed inside the enclosure to form a plurality of said flow augmentation apertures around the propeller for an increase in the back pressure within the enclosure.

10. The apparatus as claimed in claim 9 wherein the propeller has a relatively low aspect ratio in the range from about 0.1 to about 3.0.

11. The apparatus as claimed in claim 8 wherein said propulsion ring is placed inside the enclosure so that a reverse upstream fluid flow arising from inside the enclosure is converted to useful fluid flow passing radially outwardly from the propeller through said flow augmentation aperture.

12. A fan for moving air through an opening in a housing having a wall to which the fan is mounted, comprising:

a motor;

a propeller mounted in the opening and coupled to the motor for rotation thereby about an axis to move air downstream through the opening in the wall into the housing;

a multiple ring cage structure formed of a plurality of rings and placed to surround the propeller within its axial span, said rings being so sized and so spaced from each other and from the propeller as to enable gas tip vortices from the propeller to be converted to useful gas flow;

selected rings being mounted outside of the housing wall and at least one of said rings being mounted inside the housing wall around the opening and being so spaced from the wall so as to redirect upstream gas flow, arising inside the housing, into useful gas flow that is recirculated into the housing, whereby a gas seal effect is obtained between the propeller and the wall against seepage of air from inside the housing through the opening.

13. The fan as claimed in claim 12 wherein at least one of said rings has an inside edge provided with discontinuities to produce vortices for an enhancement of the flow from the propeller.

14. The fan as claimed in claim 13 wherein said discontinuities comprise teeth along the inner edge.

15. The fan as claimed in claim 13 wherein the discontinuities comprise scalloped protrusions extending inwardly from the inner edge.

16. The fan as claimed in claim 13 wherein the discontinuities comprise notches generally extending radially outwardly from the inner edge.

17. The fan as claimed in claim 13 wherein the discontinuities are in the form of bumps near the inner edge.

18. A fan for moving air through a first opening in a wall of an enclosure, comprising:

means for forming an air pressure chamber with a second opening in communication with outside air external to the air pressure chamber in desired alignment with the first opening in the wall;

a first fan having a first propeller mounted in the first opening to move air between the air pressure chamber and the enclosure in a downstream direction;

a first multiple ring cage structure formed of a plurality of rings and placed to surround the first propeller within its axial span, said rings being so sized and so spaced from each other and from the first propeller as to enable tip vortices from the propeller to be converted to useful flow in the downstream direction, selected rings being mounted within the air pressure chamber and at least one of said rings being mounted inside the enclosure and spaced from the wall;

a second fan having a second propeller mounted in the second opening to move air between outside air and said air chamber in said downstream direction;

a second multiple ring cage structure formed of a plurality of second rings and placed to surround the second propeller within its axial span, said rings of said second multiple ring structure being so sized and so spaced from each other and from the second propeller as to enable tip vortices from the second propeller to be converted to useful flow in said downstream direction, selected rings being mounted within the outside air external to the air pressure chamber with at least one of said rings of the second ring cage structure being inside the pressure chamber in spaced relationship from a wall thereof.

19. An apparatus for enhancing the mass flow from a propeller when it is rotated about an axis to establish a flow of fluid from an upstream side towards a downstream side, comprising:

a multiple ring cage structure formed of a plurality of rings and placed to surround the propeller, at least one of said rings being located within the axial span of said propeller and another ring being located downstream of said one ring;

said rings being so axially-spaced from each other and from the propeller as to form a flow augmenting aperture between said one ring and said downstream located ring with which propeller generated vortices can be converted into useful mass flow from the propeller;

at least one of said rings being segmented so as to form circumferentially located ends for the generation of vortices which enhance the flow from the propeller.

20. An apparatus for enhancing the performance of a propeller when it is rotated about an axis to establish a flow of fluid from an upstream side towards a downstream side, comprising:

a multiple ring cage structure formed of a plurality of rings and placed to surround the propeller, at least one of said rings being located within the axial span of said propeller and another ring being located downstream of said one ring;

said rings being so axially-spaced from each other and from the propeller as to form a flow augmenting aperture between said one ring and said downstream located ring with which propeller generated vortices can be converted into useful mass flow from the propeller;

at least one of said rings having discontinuities on an inner edge thereof to enhance the generation of vortices and the downstream flow from the propeller.

21. The fan as claimed in claim 20 wherein said discontinuities comprise teeth along the inner edge.

22. The fan as claimed in claim 20 wherein the discontinuities comprise scalloped protrusions extending inwardly from the inner edge.

23. The fan as claimed in claim 20 wherein the discontinuities comprise notches generally extending radially outwardly from the inner edge.

24. The fan as claimed in claim 20 wherein the discontinuities are in the form of bumps near the inner edge.

25. An apparatus for enhancing the performance of a propeller when it is rotated about an axis to establish a flow of fluid from an upstream side towards a downstream side, comprising:

a multiple ring cage structure formed of a plurality of rings and placed to surround the propeller, at least one of said rings being located within the axial span of said propeller and another ring being located downstream of said one ring;

said rings being so axially-spaced from each other and from the propeller as to form a flow augmenting aperture between said one ring and said downstream located ring with which propeller generated vortices can be converted into useful mass flow from the propeller;

at least one of said rings being shaped and arranged in the form of a continuous spiral around the propeller.

26. The fan as claimed in claim 25 wherein said ring, which is arranged in the form of a continuous spiral, includes a heater element.

27. An apparatus for moving fluid through an opening in a wall to which the apparatus is mounted, comprising:

a motor;

a propeller mounted in the opening and being coupled to the motor for rotation thereby about an axis to move fluid downstream through the opening;

a propulsion ring spaced from the wall and being so placed so that the ring and the wall surround the propeller within its axial span, said ring being so radially-spaced from the propeller and being so sized and so axially-spaced from the wall as to form between the wall and the propulsion ring, a flow augmentation aperture with which fluid, tip vortices from the propeller are converted to useful fluid flow from the propeller.

* * * * *